US005173222A

United States Patent [19]

Young et al.

[11] Patent Number: 5,173,222

[45] Date of Patent: Dec. 22, 1992

[54] REPAIRING RAIL TIES

[75] Inventors: Hartley F. Young, Maidstone; William D. Hossack, Gawler East, both of Australia

[73] Assignee: McKay Australia Limited, Maidstone, Australia

[21] Appl. No.: 710,562

[22] Filed: Jun. 5, 1991

[30] Foreign Application Priority Data

Jun. 7, 1990 [AU] Australia ..... PK0532

[51] Int. Cl.[5] ..... B32B 35/00; E02D 37/00; E04G 23/02

[52] U.S. Cl. ..... 264/35; 52/514; 52/743; 156/94; 264/36; 425/12; 427/140

[58] Field of Search ..... 264/31-36; 427/140; 52/514, 743; 156/94,98; 425/12, 11, 13

[56] References Cited

U.S. PATENT DOCUMENTS

| | | | |
|---|---|---|---|
| 1,475,029 | 11/1923 | Risk | 264/36 |
| 3,194,853 | 7/1965 | Weise et al. | 264/36 |
| 3,713,926 | 1/1973 | Speer | 156/98 |
| 3,716,608 | 2/1973 | Neumann | 264/36 |
| 3,810,801 | 5/1974 | Speer | 264/36 X |
| 3,863,329 | 2/1975 | Bartlett | 264/35 X |
| 3,940,463 | 2/1976 | Nicholson | 264/40.1 X |
| 4,086,309 | 4/1978 | Alberts | 264/35 |
| 4,152,185 | 5/1979 | Tessenske | 156/94 |
| 4,323,526 | 4/1982 | Hilbush, III | 264/36 |
| 4,616,395 | 10/1986 | Farese et al. | 264/35 X |
| 4,661,532 | 4/1987 | Morin | 264/36 X |
| 4,743,415 | 5/1988 | Crouzet | 264/35 |
| 4,828,879 | 5/1989 | Sellstrom et al. | 264/36 X |
| 4,874,675 | 10/1989 | Ceska | 427/140 X |
| 4,954,300 | 9/1990 | Dotson | 264/36 |

FOREIGN PATENT DOCUMENTS

| | | | |
|---|---|---|---|
| 627835 | 9/1961 | Canada | 427/140 |
| 8103305 | 11/1981 | PCT Int'l Appl. | 156/94 |
| 8803090 | 5/1988 | PCT Int'l Appl. | 427/140 |
| 9010771 | 9/1990 | PCT Int'l Appl. | 427/140 |
| 1301722 | 4/1987 | U.S.S.R. | 264/36 |
| 821535 | 10/1959 | United Kingdom | 264/36 |

*Primary Examiner*—Karen Aftergut
*Attorney, Agent, or Firm*—Hodgson, Russ, Andrews, Woods & Goodyear

[57] ABSTRACT

A method for repairing eroded concrete rail ties. An abrasion resistant composition incorporating a curable binder is applied to the eroded rail seat and cured by the application of pressure and heat. A gas fired heating plate with a release surface is pressed onto the composition to force it into the eroded recess and cure it. The device incorporating the heating plate is clamped onto the rail clamp shoulders embedded in the concrete rail tie to enable pressure to be applied.

2 Claims, 1 Drawing Sheet

Figure 1:
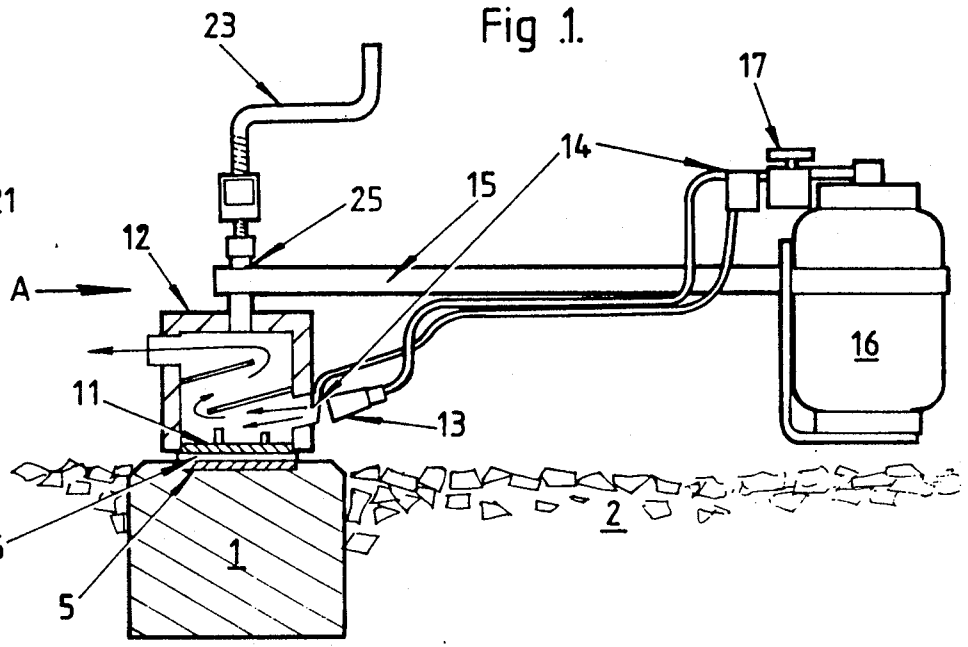

16
17
14
15
13
25
23
2
1
12
11
A
5
6

B
23
20
21
3
10
4
21
3

C
C
27
26
3
15
10
10
4
27
3
26

REPAIRING RAIL TIES

This invention relates to a method and apparatus for repairing damaged concrete rail ties.

Conventionally, rails are held to rail ties by rail clips or fasteners which bear down on the rail flange. The elastomeric material such as rubber, polyurethane, ethyl vinyl acetate or high density polyethylene insulates the rail from the rail ties.

This pad has a field side on the outer side of the rail and a gauge side on the inner side of each rail.

Concrete rail ties have been found to be prone to wear particularly in sandy and wet locations or on steep grades where the locomotives use sand for traction. This invention is particularly predicated on discovering the cause of this wear. As each loaded bogey passes over the tie, the rail pad deflects vertically and thus acts as a shock absorber. However, due to the poissons ratio of the material used, the pad must also deflect horizontally which means that every vertical load pulse causes the pad face to slide horizontally over the concrete ties.

In normal use this causes slight wear to the pad and practically no wear to the concrete face. However, in the presence of sand particles the grains of sand cut into the cement paste in the mortar causing abrasion to the concrete paste and mortar which shorten the working life of the concrete rail tie.

The problem is made worse by the presence of water which carries the sand particles under the pad and since the tie face is not absolutely flat, any microscopic gap between the tie and the rail pad is filled with water which is expelled when the load is applied to the pad. This pumping and jetting action of the water causes wear to the concrete mortar and in addition acts as a distribution method for the sand particles which further aggravate the problem. U.S. patent application 511,037 filed Apr. 19, 1990 discloses a rail seat construction utilizing an abrasion resistant plate to overcome this problem.

U.S. patent application 511,037 discloses an abrasion resistant concrete composition which can be used to form or repair rail ties to reduce erosion of the tie because of this problem.

It is an object of this invention to provide a method and apparatus to repair rail ties damage by erosion utilizing the abrasion resistant composition and the abrasion plate disclosed above.

This invention overcomes two problems:

1. To repair abraded ties quickly enough to limit hold up to freight traffic to an acceptable time.

2. To restore badly abraded rail seats to their original dimensions.

The paste previously described in U.S. application 511,037 is an effective material for repairing damaged rail seats and also reducing further abrasion, but when applied in a relatively thin layer, the cure time is greatly extended and even with fast curing binders can take 12 to 36 hours at some temperatures which is completely unacceptable from a freight train operators point of view.

If freight trains are run even slowly over the freshly repaired rail seats, if the epoxy is still in a plastic state, it will be pumped out thus up setting the true level of the rail seat and causing cavities in the material and an improper bond to the abrasion plate which will all lead to subsequent failure of the rail seat.

Accordingly to overcome these problems the present invention provides a method of repairing a rail tie comprising applying an abrasion resistant composition which includes a curable binder to the eroded area of the rail tie, pressing said composition into place and heating the applied composition for a period sufficient to cure the binder. In another aspect this invention provides apparatus for curing an applied repair composition comprising an application plate adapted to overlie the repaired area, heating means adapted to heat said plate sufficiently to accelerate curing of said repair composition, means to locate said plate and hold it in position, and means to press said plate onto the rail tie to evenly distribute the repair composition into the elected position of the rail tie.

Preferably the application plate has a non stick surface so that the binder material as it cures, does not adhere to the application plate surface. Alternatively, a sheet of non stick material such as baking paper can be laid between the heated plate and the composition.

Alternatively, the rail plate as disclosed in U.S. Pat. Specification Ser. No. 489,498 filed Mar. 7, 1990, now U.S. Pat. No. 5,110,046, can be placed on to the rail seat over the area to be repaired so that it becomes bonded to the repair composition and the rail tie.

It should be noted that repair compositions other than those disclosed in U.S. Ser. No. 511,037 filed Apr. 19, 1990 and abrasion plates other than those disclosed in patent application 489,498 can be used in this invention.

Preferably, the apparatus locates the application plate over the rail seat by guides that engage with the sides of the shoulder and stops sitting on the rail seat adjacent to the shoulder but outside the load carrying area. Clamps located in the rail clip support shoulders embedded in the concrete rail tie and pressure can be applied to the plate against these clamps. The heater plate is registered with respect to undamaged parts of the tie lying outside of the rail seat area so that the rail seat can be restored to its original alignment.

Any suitable pressure application means can be used. Similarly any suitable heating means can be used although for reasons of portability and overall safety, gas fired burners are preferred.

Figure 2:
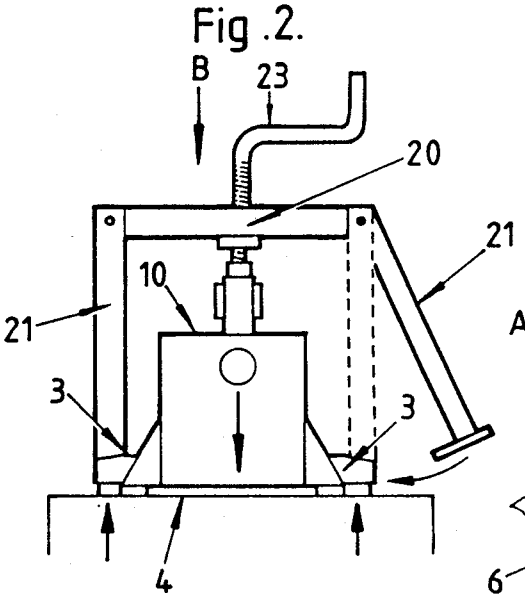

A preferred embodiment will now be described with reference to the drawings in which FIG. 1 provides a sectional view along a rail tie to be repaired, FIG. 2 is a sectional view in the direction of the rail through a rail seat being prepared and showing the apparatus of this invention.

Figure 3:
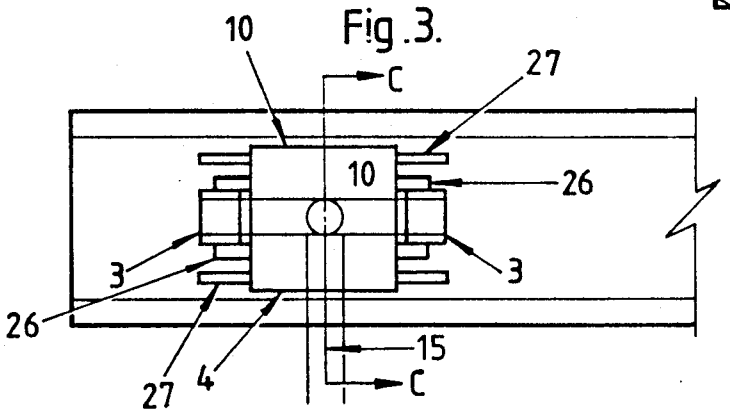

FIG. 3 is a plan view of FIG. 2.

The drawings illustrate a portable embodiment of the invention placed over a rail seat 4 on a rail tie 1. The tie 1 is surrounded by ballast 2. The rail seat 4 is defined by the edges of the rail tie 1 and the rail clamp shoulders 3, which are embedded in the concrete tie 1 and adapted to hold the rail clamps (not shown) which bear down on the flange of the rail (not shown).

The damaged rail seat is repaired by filling the worn recess 5 to receive the abrasion resistant composition. In this embodiment, an abrasion plate 6 is to be bonded to the repaired rail seat.

The hot box device 10, causes the epoxy binder materials in the repair composition to cure as quickly as 5 minutes, and the rail seat is then capable of carrying load.

The invention basically consists of a continuously heated hot plate 11 on the bottom of hot box 10, which is clamped on top of an abrasion plate covering the repair paste, and since the hot plate 11 registers on undamaged parts of the rail seat by stops 27, it is clamped down until the original alignment of the rail seat 4 is restored and any excess paste is squeezed out.

The hot plate 11 is on the bottom of a hot box 10 into which an LP Gas burner 13 is fired, thus maintaining the temperature of the bottom plate. The hot plate has attached to it a thermometer to indicate the temperature of the hot plate.

The hot plate 11 is maintained at the maximum temperature which will not cause burning or significant damage to the epoxy paste below the abrasion plate. This heat causes the epoxy paste to set very rapidly.

The hot box 10 is surrounded with insulating material 12 to minimise heat loss and to prevent the operator being burned by physical contact with the hot box.

The gas burner 13 is fired with LP gas carried in a small gas bottle 16 at the end of the carry pole 15, and at the flame section of the burner a sensor 14 is fitted which will cause the gas flow to cease if the flame goes out. The gas regulator is used to maintain and adjust the flame to hold the hot plate temperature at the required level.

Two arms 21, mounted on the frame 20, to which hot box 10 is attached and these arms 21 are swung into the fastener shoulders 3 to provide a reaction for the clamping screw 23. These arms 21 are spring loaded out of position, so that when the box 10 is placed in the rail seat 4 the arms 21 are not in the way, and then when the arms are pushed into the shoulders 3 for clamping they are spring loaded in this location as well, so the operator does not have to hold them in position while the clamping screw 23 is turned. The clamping screw 23 may be attached to the hot box 10 by a swivel joint 25 which allows the hot box 10 to tilt.

The clamping arms 21 can be provided with ends which interfit with the shape of the clamp shoulder recesses. The gas bottle 16 is mounted at the end of the carry pole 15 which serves two purposes:

1. To keep the bottle away from the burner 13 and hot box 10.

2. To counter balance the hot box 10 so the operator can lift the whole unit by the carry pole and keep the hot box away from his body, while walking to the next tie.

The hot box device 10 is light enough for one man to carry a unit in each hand.

The method of operation is as follows:

First, the rail is removed and a crew of men apply the repair composition and abrasion plates 6 to the damaged rail seats 4, and a group of men follow behind carrying two hot boxes 10 each. The operator places the hot box 10 in the rail seat 4 with the guides 26 on the box registering with the shoulder 3 give horizontal orientation and stops 27 sit on the undamaged portion of rail seat 4 to give vertical alignment. The clamping arms 21 are swung in to the shoulders 3 and then the clamping screw 23 is tensioned to restore the rail seat 4 to the correct alignment and then the unit is left to cure for approximately 5 minutes. While the first hot box is heating, the operator installs the second one and once that is complete he then moves the first one in a leap frog manner to the next rail seat and so on, thereby one man is able to work continuously without any significant time loss while the seats are cured. A timing bell can be fitted to indicate that the unit is ready to be moved. It has been found that one man can operate up to 4 hot boxes without difficulty.

From the above it can be seen that this invention provides a unique, fast and economical means to repair damaged rail seats.

We claim:

1. A method of repairing an eroded rail seat of a concrete rail tie, said rail seat comprising two support shoulders embedded in said rail tie which support shoulders are adapted to receive rail clamps, and a rail tie being adapted to lie between said shoulders, said method comprising applying to an eroded area of said rail seat an abrasion resistant repair composition which includes a curable binder, pressing said composition into said eroded area with a pressure plate which is associated with a registration means which registers on undamaged parts of said rail tie so that said repair composition is evenly distributed into said eroded area and so that said rail seat is restored to its original alignment during said pressing, biasing said pressure plate against said rail tie, and applying heat to said pressure plate to cure said repair composition, said heat and pressure applied to said repair composition by said heated pressure plate being sufficient to accelerate curing of said composition for rapid repair of said eroded area of said rail seat.

2. A method according to claim 1, wherein said pressure plate is biased against said rail tie by a device mounted in said support shoulders.

* * * * *